US008132342B1

(12) United States Patent
Moon

(10) Patent No.: US 8,132,342 B1
(45) Date of Patent: Mar. 13, 2012

(54) SANDAL ASSEMBLY

(76) Inventor: Alma J. Moon, Lodi, CA (US)

( * ) Notice: Subject to any disclaimer, the term of this patent is extended or adjusted under 35 U.S.C. 154(b) by 773 days.

(21) Appl. No.: 12/238,184

(22) Filed: Sep. 25, 2008

(51) Int. Cl.
*A43B 3/24* (2006.01)
*A43B 3/12* (2006.01)
*A43B 13/28* (2006.01)

(52) U.S. Cl. ..... 36/101; 36/11.5; 36/12

(58) Field of Classification Search ..... 36/100, 36/101, 103, 11.5, 15, 23, 24, 12
See application file for complete search history.

(56) References Cited

U.S. PATENT DOCUMENTS

| | | | | |
|---|---|---|---|---|
| 2,761,224 | A * | 9/1956 | Gardiner | 36/11.5 |
| 3,928,927 | A * | 12/1975 | Brown et al. | 36/11.5 |
| 3,978,596 | A * | 9/1976 | Brown et al. | 36/11.5 |
| 4,172,330 | A | 10/1979 | Kao | |
| D384,495 | S | 10/1997 | Watson | |
| 6,349,486 | B1 | 2/2002 | Lin | |
| 6,442,869 | B2 | 9/2002 | Coomes | |
| 6,543,157 | B2 * | 4/2003 | Pan | 36/11.5 |
| 6,848,199 | B1 | 2/2005 | Giannelli | |
| 7,200,959 | B2 | 4/2007 | Spann | |
| 7,222,441 | B2 | 5/2007 | Smith et al. | |
| 7,681,330 | B2 * | 3/2010 | Lewis | 36/11.5 |
| 7,954,260 | B2 * | 6/2011 | Enderson | 36/101 |
| 2004/0093765 | A1 | 5/2004 | Baldwin | |
| 2006/0254085 | A1 | 11/2006 | Mollicone | |

* cited by examiner

*Primary Examiner* — Jila Mohandesi
*Assistant Examiner* — Melissa Lalli

(57) ABSTRACT

A sandal assembly includes a base that has top side, a bottom side, a first lateral edge, a second lateral edge, a front edge and a rear edge. A foot strapping system to releasably secure a foot to the base includes a first tether that has a free first end and a free second end. Each of the first and second ends is removably extended into the top side of the base. The top side of the base includes a plurality of wells extending therein. Each of the wells receives one of the first and second ends. A first well of the plurality of wells is positioned adjacent to the first lateral edge and a second well of the plurality of wells is positioned adjacent to the second lateral edge.

4 Claims, 4 Drawing Sheets

28
26
34
60
36
60
32
43
14
30
52
20
56
58
42
18
48
54
41
44
48
50
46
50

SANDAL ASSEMBLY

BACKGROUND OF THE INVENTION

Field of the Invention

The present invention relates to shoe devices and more particularly pertains to a new shoe device for allowing a person to customize the appearance of a sandal.

SUMMARY OF THE INVENTION

The present invention meets the needs presented above by generally comprising a base that has top side, a bottom side, a first lateral edge, a second lateral edge, a front edge and a rear edge. A foot strapping system to releasably secure a foot to the base includes a first tether that has a free first end and a free second end. Each of the first and second ends is removably extended into the top side of the base. The top side of the base includes a plurality of wells extending therein. Each of the wells receives one of the first and second ends. A first well of the plurality of wells is positioned adjacent to the first lateral edge and a second well of the plurality of wells is positioned adjacent to the second lateral edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
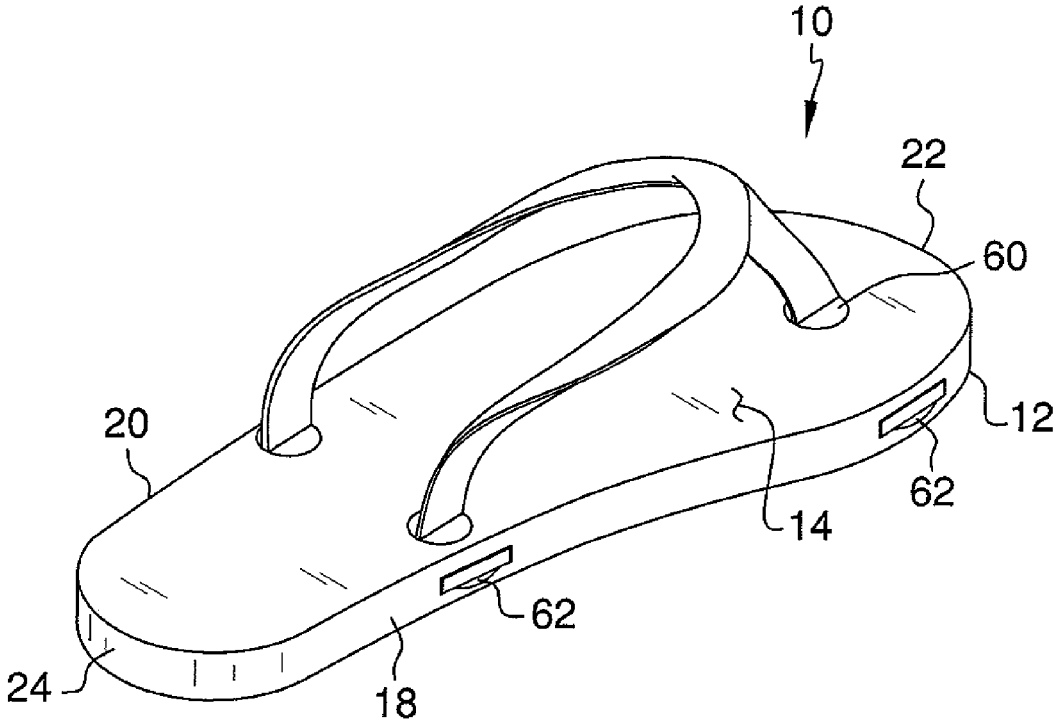
FIG. 1 is a top perspective view of a sandal assembly according to the present invention.
Figure 2:
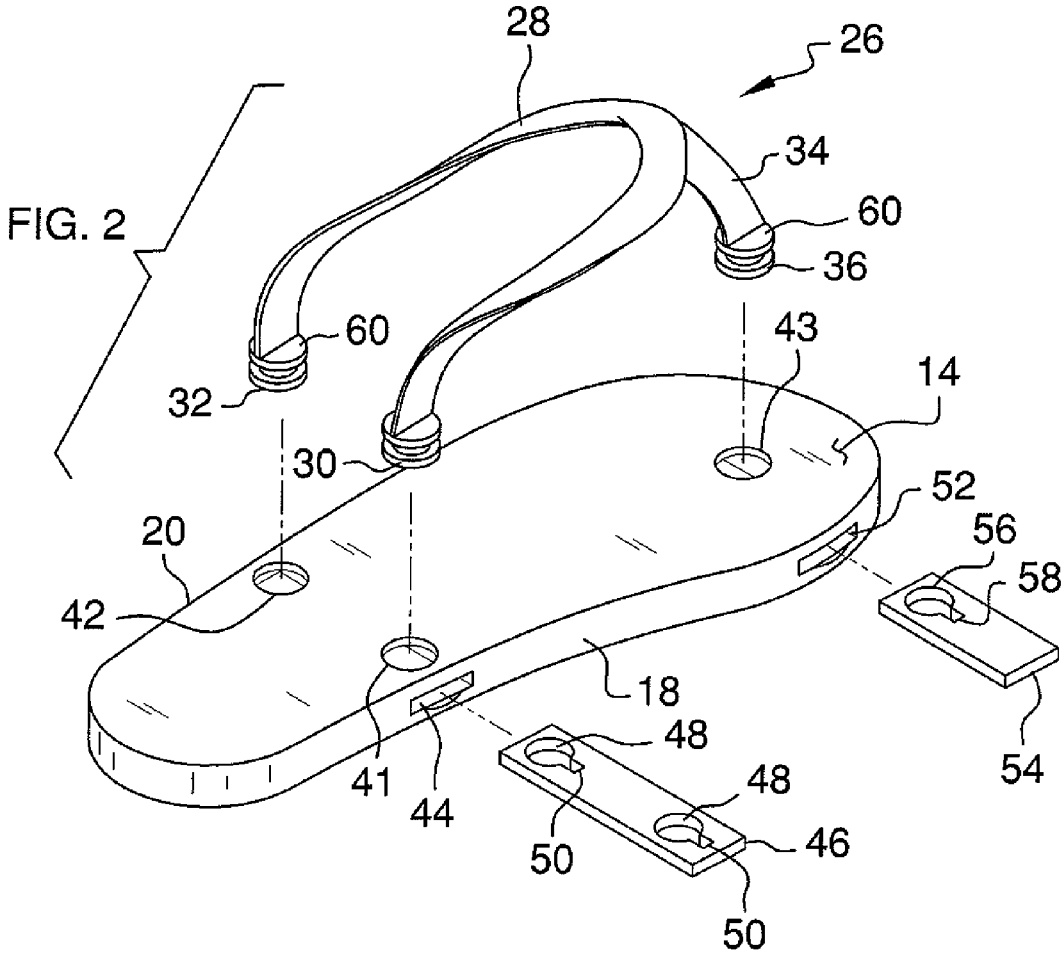
FIG. 2 is an expanded top perspective view of the present invention.

With reference now to the drawings, and in particular to FIGS. 1 through 6 thereof, a new shoe device embodying the principles and concepts of the present invention and generally designated by the reference numeral 10 will be described.

Figure 3:
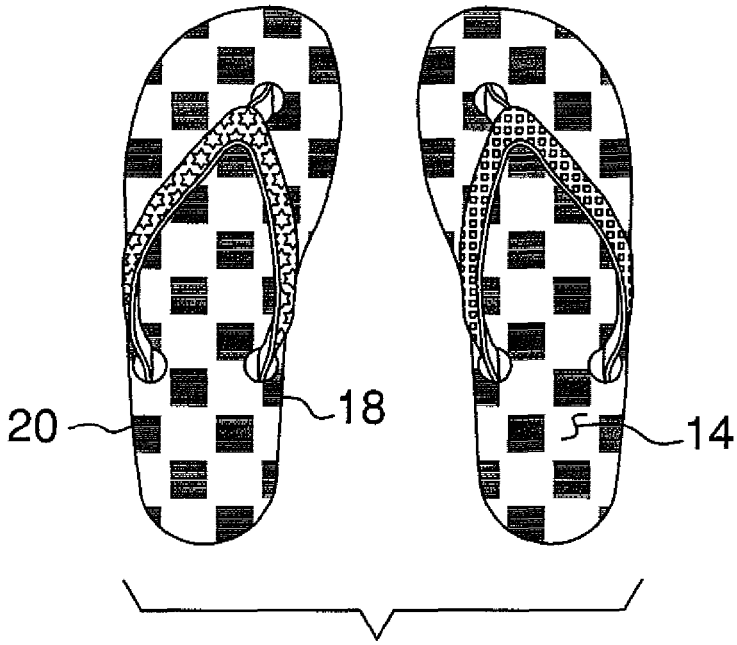
FIG. 3 is a top view of the present invention.
Figure 4:
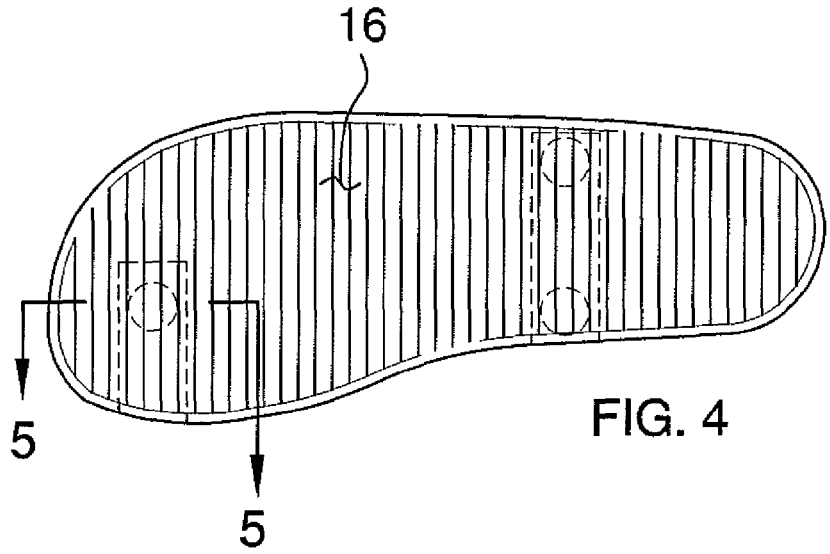
FIG. 4 is a bottom view of the present invention.
Figure 5:
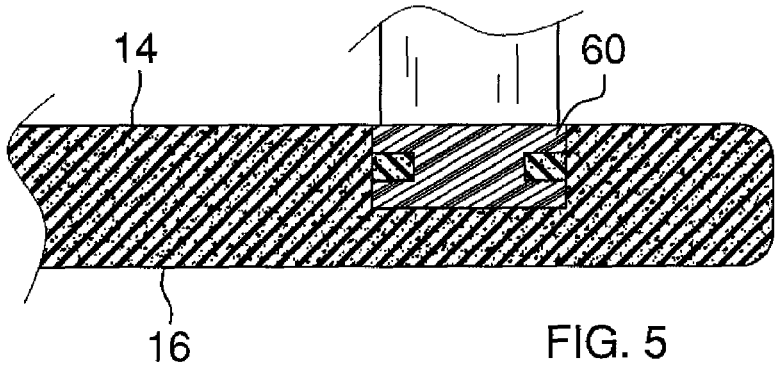
FIG. 5 is a cross-sectional view taken along line 5-5 of FIG. 4 of the present invention.
Figure 6:
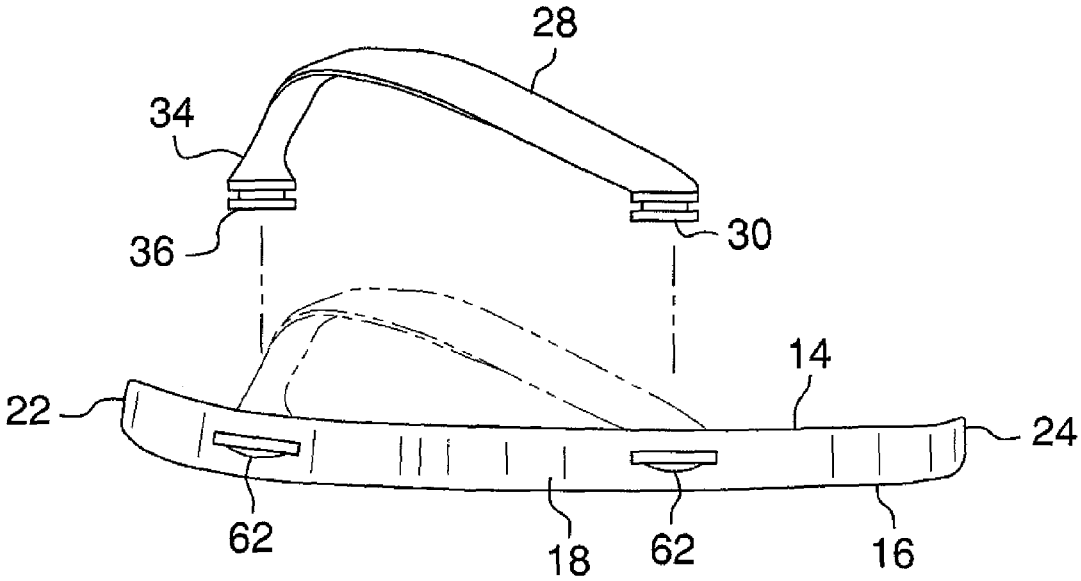
FIG. 6 is a side view of the present invention.

As best illustrated in FIGS. 1 through 6, the sandal assembly 10 generally comprises a base 12 that has top side 14, a bottom side 16, a first lateral edge 18, a second lateral edge 20, a front edge 22 and a rear edge 24. Each of the front 22 and rear 24 edges is convexly arcuate. The base 12 may be comprised of any conventional material used for a sandal such as plastics, elastomeric materials, leather, synthetic materials and combinations thereof. As can be seen in FIG. 3, the top side 14 may include design indicia.

A foot strapping system 26 includes a first tether 28 that has a free first end 30 and a free second end 32. A second tether 34 is attached to the first tether 28 between the first 30 and second 32 ends. The second tether 34 has a free third end 36. Each of the first 30, second 32 and third 36 ends is removably extended into the top side 14 of the base 12. The foot strapping system 26 is used to engage a person's foot to releasably couple the foot to the base 12.

The top side 14 of the base 12 includes a plurality of wells 41, 42, 43 extending therein. Each of the wells 41, 42, 43 receives one of the first 30, second 32, or third 36 ends. A first well 41 of the plurality of wells is positioned adjacent to the first lateral edge 18. A second well 42 of the plurality of wells is positioned adjacent to the second lateral edge 20. The first 41 and second 42 wells are positioned nearer to the rear edge 24 than the front edge 22. A third well 43 of the plurality of wells is positioned between the first 18 and second 20 lateral edges and nearer to the front edge 22 than the rear edge 24.

A primary slot 44 extends into the first lateral edge 18. The primary slot 44 extends toward the second lateral edge 20 and extends through the first 41 and second 42 wells. A primary coupler 46 is mounted in the primary slot 44. The primary coupler 46 comprises a plate having a pair of apertures 48 extending therethrough. Each of the apertures 48 is simultaneously alignable with one of the first 41 and second 42 wells to allow the first 30 and second 32 ends to be extended through the apertures 48. Each of the apertures 48 has a perimeter edge having a notch 50 therein. The first 30 and second 32 ends each comprises a flange that is positionable under the primary coupler 46 when the first tether 28 is extended into the notches 50 of the apertures 48 to releasably lock the first 30 and second 32 ends in the base 12.

A secondary slot 52 extends into the first lateral edge 18. The secondary slot 52 extends toward the second lateral edge 20 and extends through the third well 42. A secondary coupler 54 is mounted in the secondary slot 52. The secondary coupler 54 also comprises a plate having an opening 56 extending therethrough. The opening 56 is alignable with the third well 43 to allow the third end 36 to be extended through the opening 56. The opening 56 has a perimeter edge that has a notch 58 therein. The third end 36 comprises a flange that is positionable under the secondary coupler 54 when the second tether 34 is extended into the notch 58 of the opening 56 to releasably lock the third end 36 in the base 12.

In use, the foot strapping system 26 is secured to the base 12 and the assembly 10 worn as a conventional sandal. If the user of the assembly 10 decides to replace the foot strapping system 26 for either structural reasons or because the user wishes to alter the appearance of the assembly 10, the user may remove the foot strapping system 26 and replace it with another of different color or having different designs thereon. The first 30, second 32 and third 36 ends are extended into the wells 41, 42, 43 and through the apertures 48 and openings 56 as described above. The primary 46 and secondary 54 couplers are then slid within their respective primary 44 and secondary 52 slots to move the tethers 28, 34 into the notches 50, 58 to position the primary 46 and secondary 54 couplers between the flanges and the top side 14 of the base 12. This prevents the tethers 28, 34 from being removed from the wells 41, 42, 43. Each of the tethers 28, 34 may include a shoulder 60 spaced from an associated one of the flanges to position the shoulders 60 flush with the top side 14 when the tethers 28, 34 are secured to the base 12. Fingernail catches 62 may be positioned adjacent to the primary 44 and secondary 52 slots to assist a user in actuating the primary 46 and secondary 54 couplers. It should also be understood that a pair of assemblies 10 is used at the same time.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sandal assembly including:

a base having top side, a bottom side, a first lateral edge, a second lateral edge, a front edge and a rear edge, each of said front and rear edges being convexly arcuate;

a foot strapping system including a first tether having a free first end and a free second end, each of said first and second ends being removably extended into said top side of said base; and said top side of said base including a plurality of wells extending therein, each of said wells receiving one of said first and second ends, a first well of said plurality of wells being positioned adjacent to said first lateral edge, a second well of said plurality of wells being positioned adjacent to said second lateral edge;

a primary slot extending into said first lateral edge, said primary slot extending toward said second lateral edge and extending through said first and second wells;

a primary coupler being mounted in said primary slot and releasably engaging said first and second ends;

said primary coupler has a pair of apertures extending therethrough, each of said apertures being simultaneously alignable with one of said first and second wells to allow said first end to be extended through a first of said apertures and said second end to be extended through a second of said apertures, each of said apertures having a perimeter edge having a notch therein, said first and second ends each comprising a flange being positionable under said primary coupler when said first tether is extended into said notches of said apertures to releasably lock said first and second ends in said base.

2. The assembly according to claim 1, wherein said foot strapping system further includes a second tether being attached to said first tether between said first and second ends, said second tether having a free third end, said third end being removably extended into said top side of said base, said first and second wells being positioned nearer to said rear edge than said front edge, a third well of said plurality of wells being positioned between said first and second lateral edges and nearer to said front edge than said rear edge, said third well receiving said third end.

3. The assembly according to claim 2, further including:

a secondary slot extending into said first lateral edge, said secondary slot extending toward said second lateral edge and extending through said third well; and a secondary coupler being mounted in said secondary slot and releasably engaging said third end.

4. A sandal assembly including:

a base having top side, a bottom side, a first lateral edge, a second lateral edge, a front edge and a rear edge, each of said front and rear edges being convexly arcuate;

a foot strapping system including a first tether having a free first end and a free second end, a second tether being attached to said first tether between said first and second ends, said second tether having a free third end, each of said first, second and third ends being removably extended into said top side of said base;

said top side of said base including a plurality of wells extending therein, each of said wells receiving one of said first, second, or third ends, a first well of said plurality of wells being positioned adjacent to said first lateral edge, a second well of said plurality of wells being positioned adjacent to said second lateral edge, said first and second wells being positioned nearer to said rear edge than said front edge, a third well of said plurality of wells being positioned between said first and second lateral edges and nearer to said front edge than said rear edge;

a primary slot extending into said first lateral edge, said primary slot extending toward said second lateral edge and extending through said first and second wells;

a primary coupler being mounted in said primary slot, said primary coupler having a pair of apertures extending therethrough, each of said apertures being simultaneously alignable with one of said first and second wells to allow said first end to be extended through a first of said apertures and said second end to be extended through a second of said apertures, each of said apertures having a perimeter edge having a notch therein, said first and second ends each comprising a flange being positionable under said primary coupler when said first tether is extended into said notches of said apertures to releasably lock said first and second ends in said base;

a secondary slot extending into said first lateral edge, said secondary slot extending toward said second lateral edge and extending through said third well; and a secondary coupler being mounted in said secondary slot, said secondary coupler having an opening extending therethrough, said opening being alignable with said third well to allow said third end to be extended through said opening, said opening having a perimeter edge having a notch therein, said third end comprising a flange being positionable under said secondary coupler when said second tether is extended into said notch of said opening to releasably lock said third end in said base.

* * * * *